US007909046B2

(12) United States Patent
Kim et al.

(10) Patent No.: US 7,909,046 B2
(45) Date of Patent: Mar. 22, 2011

(54) STEAM DISH WASHING MACHINE WITH EFFECTIVE POSITIONING AND ORIENTATION OF ITEMS TO BE WASHED

(75) Inventors: Min Chul Kim, Changwon-Si (KR); Sang Woo Woo, Changwon-Si (KR); Pil Keun Park, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 384 days.

(21) Appl. No.: 12/071,290

(22) Filed: Feb. 19, 2008

(65) Prior Publication Data

US 2009/0007941 A1 Jan. 8, 2009

(30) Foreign Application Priority Data

May 31, 2007 (KR) ..... 10-2007-0053223
Aug. 6, 2007 (KR) ..... 10-2007-0078522

(51) Int. Cl.
*B08B 3/10* (2006.01)

(52) U.S. Cl. ..... 134/105; 134/108

(58) Field of Classification Search ..... 134/105, 134/108

See application file for complete search history.

(56) References Cited

U.S. PATENT DOCUMENTS

| | | | | |
|---|---|---|---|---|
| 3,893,340 | A * | 7/1975 | Parker | 374/161 |
| 4,366,005 | A * | 12/1982 | Oguri et al. | 134/25.2 |
| 4,462,175 | A * | 7/1984 | Romberger | 40/1 |
| 6,588,134 | B1 * | 7/2003 | Perelli | 40/617 |
| 2002/0078977 | A1 * | 6/2002 | Manne | 134/25.2 |
| 2004/0187898 | A1 | 9/2004 | Chen | |

FOREIGN PATENT DOCUMENTS

| | | | |
|---|---|---|---|
| CN | 1931079 | | 3/2007 |
| CN | 1931080 | | 3/2007 |
| DE | 42 19 942 | * | 6/1993 |
| DE | 195 00 176 | * | 7/1996 |
| DE | 101 26 287 | * | 12/2002 |
| EP | 1 759 622 A2 | | 3/2007 |
| EP | 1 759 623 A1 | | 3/2007 |
| JP | 02-082930 | | 3/1990 |
| JP | 2004-298514 | * | 10/2004 |
| JP | 2005-227149 | * | 8/2005 |
| KR | 1999-001225 | | 1/1999 |

OTHER PUBLICATIONS

WIPO WO 04/24615 Oct. 1994.*

* cited by examiner

*Primary Examiner* — Frankie L Stinson
(74) *Attorney, Agent, or Firm* — McKenna Long & Aldridge LLP

(57) ABSTRACT

Dish washing machine that includes a steam generator, which supplies steam during a washing operation, to aid in the washing of dishes and other items in the dish washing machine. The dish washing machine further including one or more dish washing racks that effectively orient the dishes, and other items to be washed, in such a way so as to avoid inhibiting the steam from being evenly distributed around each of the dishes and other items to be washed. The dish washing machine also including a steam zone indicator to aid in effectively positioning the dishes and other items to be washed by visually distinguishing the region or zone within the dish washing machine that corresponds with high-intensity steam.

8 Claims, 6 Drawing Sheets

STEAM DISH WASHING MACHINE WITH EFFECTIVE POSITIONING AND ORIENTATION OF ITEMS TO BE WASHED

CROSS-REFERENCE TO RELATED APPLICATION

This application claims the benefit of Korean Patent Application No. 10-2007-0053223, filed on May 31, 2007; and Korean Patent Application No. 10-2007-0078522, filed on Aug. 6, 2007, which are hereby incorporated by reference in their entireties as if fully set forth herein.

BACKGROUND OF THE INVENTION

1. Field of the Invention

The present invention relates to a dish washing machine that includes a steam generator and a steam nozzle. More specifically, the present invention relates to a dish washing machine that promotes the efficient use of steam through proper positioning and orientation of the dishes, and/or other items to be washed, relative to the steam nozzle and the direction of the steam flow.

2. Discussion of the Related Art

A conventional dish washing machine sprays wash water onto the dishes and other items placed in the dish washing machine. In general, the dish washing machine uses high water pressure to remove foreign matter, such as food particles and other waste, on the dishes and other items. The foreign matter is filtered so that the wash water can be re-used (i.e., recirculated). Detergent is dissolved in the wash water to break up and/or loosen the foreign matter so that it can more easily be removed from the dishes and other items. It will be understood that these other items may include, pots, pans, utensils, glassware, and the like. However, for purposes of discussion only, the disclosure herein below will refer only to dishes.

To improve the functionality of the dish washing machine, the wash water may be heated. Doing so, makes the detergent more effective, thereby, improving the washing efficiency of the dish washing machine. However, even if the dish washing machine heats the wash water, the most stubborn food waste, e.g., baked-on food waste, is still difficult to remove. Presoaking the dishes using high temperature wash water may help, but the soaking process requires a great deal of time and the operational cycle of the dish washing machine must then be extended accordingly.

SUMMARY OF THE INVENTION

The present invention is directed to a dish washing machine that employs steam to obviate the aforementioned and other problems, limitations and disadvantages associated with conventional dish washing machines. The present invention is further directed to a dish washing machine that maximizes the effectiveness of steam by more effectively positioning and orienting the dishes relative to the steam nozzle and the direction of the steam flow.

One advantage of the present invention is that the effects of steam are maximized by effectively positioning and orienting the dishes.

Another advantage of the present invention is that foreign matter, such as food particles and other waste, is more effectively removed from dishes when using steam.

Still another advantage of the present invention is that foreign matter, such as food particles and other waste, is more efficiently removed from dishes when using steam.

Additional advantages, objects, and features of the present invention will be set forth, in part, in the following description, including the claims and the drawings, and in addition, said advantages, objects and features will become apparent to those having ordinary skill in the art from practicing the invention.

In accordance with one aspect of the present invention, the aforementioned and other advantages are achieved by a dish washing machine comprising a tub, that defines a washing space therein; a steam generator which generates steam during a washing operation; a steam nozzle that sprays the steam generated by the steam generator into the washing space generally in a first direction. In addition, the dish washing machine comprises a rack that is configured to receive items to be washed, wherein the items, when received, are oriented relative to the first direction, due to the configuration of the rack, such that the steam evenly flows unimpeded around each of the items.

In accordance with one aspect of the present invention, the aforementioned and other advantages are achieved by a dish washing machine comprising a tub that defines a washing space therein; a steam generator that generates steam during a washing operation; a steam nozzle that sprays steam generated by the steam generator into the washing space. In addition, the dish washing machine comprises a steam zone indicator that visually distinguishes a region within the washing space associated with high-intensity steam.

It is to be understood that both the foregoing general description and the following detailed description of the present invention are exemplary and explanatory. The description is intended to provide further explanation of the invention, as set forth in the appended claims.

BRIEF DESCRIPTION OF THE DRAWINGS

The accompanying drawings, which are included to provide a further understanding of the invention, are incorporated in and constitute a part of this disclosure. They illustrate different aspects of the exemplary embodiments of the present invention, and together with the description, serve to explain the present invention. In the drawings.

DETAILED DESCRIPTION OF THE INVENTION

Reference will now be made in detail to exemplary embodiments of the present invention, which are illustrated in the accompanying drawings. Wherever possible, the same or similar reference numbers will be used throughout the drawings to refer to same or like parts.

Figure 1:
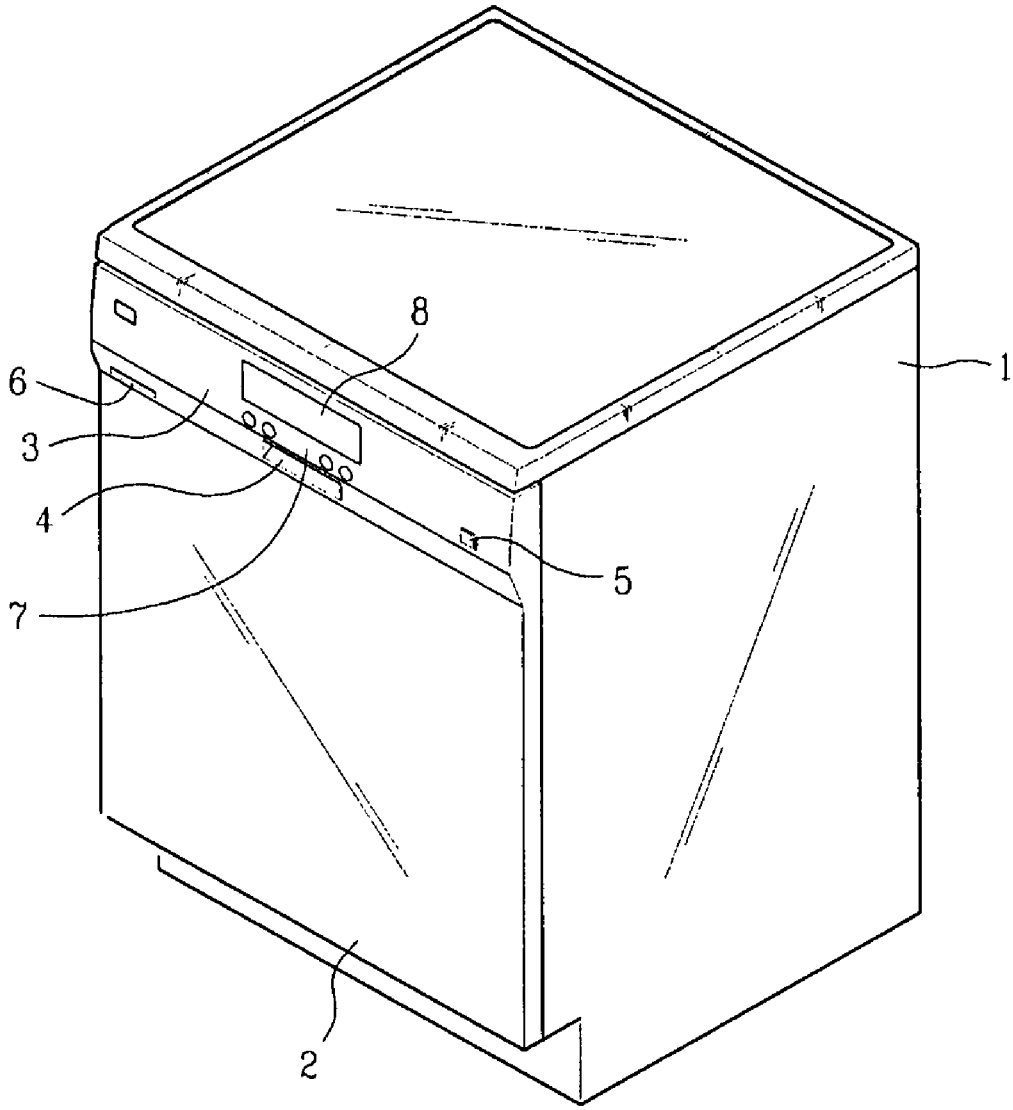
FIG. 1 is a perspective view of a dish washing machine in accordance with exemplary embodiments of the present invention.

FIG. 1 a perspective view of a dish washing machine according to exemplary embodiments of the present invention. The dish washing machine includes a case 1, which defines the external appearance of the dish washing machine. Case 1 is open in the front to accommodate a door 2, through which, the user may access the dish washing space or compartment inside the dish washing machine. The door 2 includes a door grip 4 to aid in opening the door 2, and a steam discharge port 6, which provides an outlet for high temperature air and/or steam to be discharged from within the dish washing space or compartment.

In this exemplary embodiment, a control panel 3 is integrated into the top portion of the door 2. The control panel 3 includes a power switch 5 for turning the dish washing machine on and off; a function selection part 7, which is used to select the desired dish washing operation; and a display part 8 for displaying the operational state of the dish washing machine.

Figure 2:
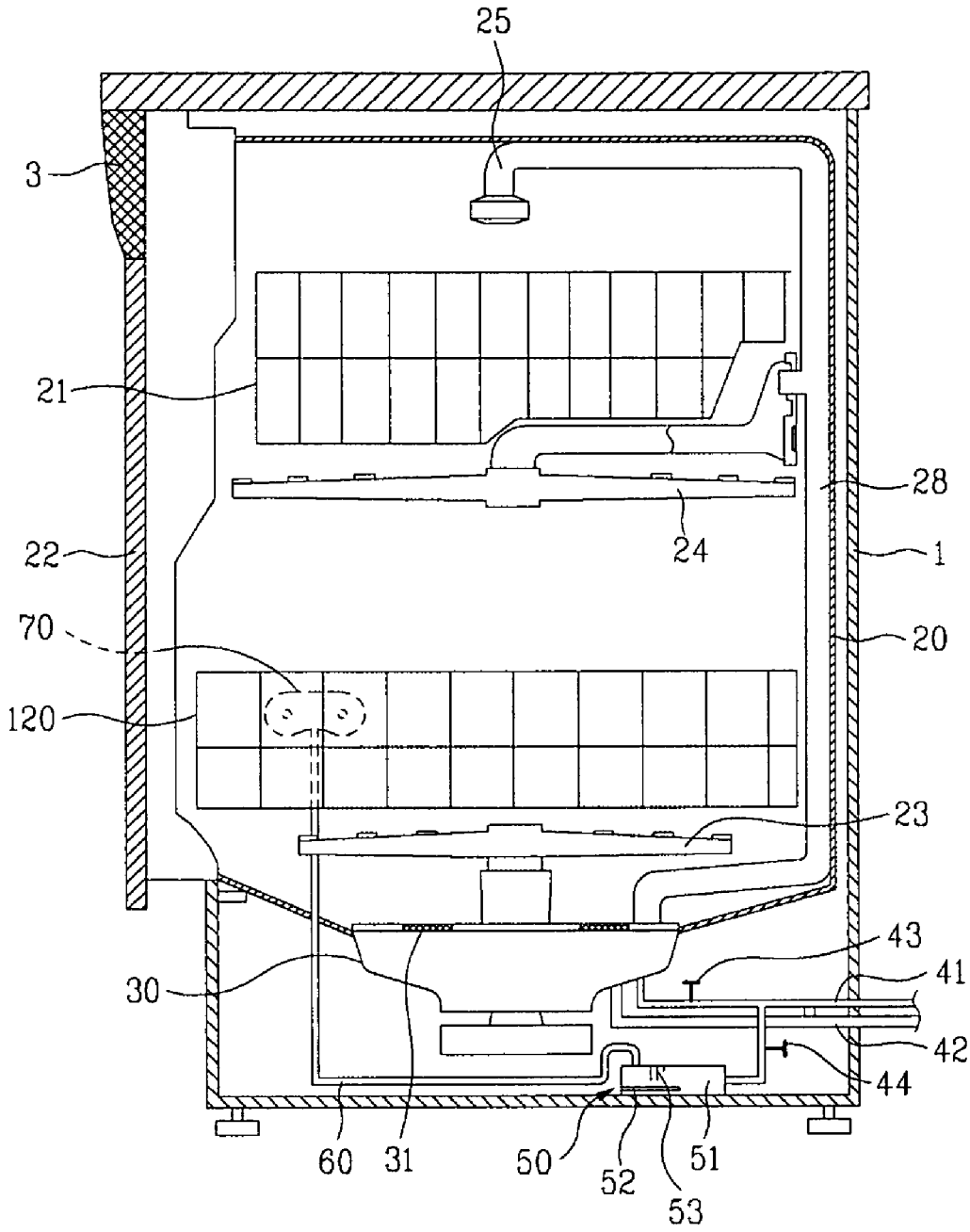
FIG. 2 is a vertical, sectional view of a the dish washing machine in accordance with exemplary embodiments of the present invention.

FIG. 2 is a vertical, sectional view of a dish washing machine in accordance with exemplary embodiments of the present invention. The dish washing machine, as shown, includes a tub 20 mounted inside case 1, where tub 20 defines the dish washing space or compartment. The dish washing machine also includes a sump 30 mounted at the bottom of tub 20. Sump 30 collects the wash water so that the wash water can be re-circulated.

The sump 30 includes a pump (not shown) for pumping the wash water in the sump 30 back into the dish washing compartment. The sump 30 preferably includes a heater (not shown) for heating the wash water in the sump 30. As stated, heating the wash water tends to make the detergent more effective in terms of dissolving food waste on the dishes.

The dish washing machine in FIG. 2 further includes an upper dish washing machine rack 21 and a lower dish washing machine rack 120. Also included, are spray arms 23 and 24, which spray wash water toward the lower rack 120 and the upper rack 21, respectively. A separate spray arm 25 is employed for spraying wash water from the top of and downward into the dish washing compartment.

Associated with sump 30 is a filter 31. When wash water passes through filter 31, food particles and other waste in the wash water are filtered out. A wash water flow channel 28, mounted to tub 20, transports the filtered wash water from sump 30 to the spray arms 24 and 25.

Still further, the dish washing machine illustrated in FIG. 2 includes a steam generator 50. Steam generator 50 generates and supplies steam to the dish washing compartment, via steam flow channel 60 and at least one steam nozzle, for example, steam nozzle 70. The steam generator 50 is, preferably, mounted below the tub 20. This allows the steam to be more easily supplied to the dish washing compartment. That is because steam is lighter than air. Therefore, the steam tends to rise upward through the steam flow channel 60 and the steam nozzle 70 into the dish washing compartment. However, the present invention is not limited to this particular positioning of the steam generator 50. For example, the steam generator 50 may be mounted to the side of tub 20, or in any other preferable location. The steam generator 50 includes a case 51, a heater 52 for heating the water contained in the steam generator 50, a water level sensor 106, and a fuse (not shown) for preventing the heater 52 from overheating.

The dish washing machine further includes a water supply pipe 41 which is connected to a water supply source external to the dish washing machine. As shown, the water supply pipe 41, in this exemplary embodiment, branches in order to supply water to the dish washing compartment, via sump 30, and the steam generator 50. The dish washing machine also includes a water drainage pipe 42 for draining dirty wash water after the wash water has been used to wash the dishes. The water supply pipe 41 has a tub valve 43 and a steam valve 44 to control the flow of water to the dish washing compartment and the steam generator 50, respectively.

The general operation of the dish washing machine illustrated in FIGS. 1 and 2, in accordance with exemplary embodiments of the present invention, will now be described. First, the user places the dishes on the upper rack 21 and/or the lower rack 120, as desired. The user then closes the door 2. The user then selects the desired dish washing operation using the function selection part 7 and initiates the operation of the dish washing machine. The dish washing operation is then performed based on the user selection, while the operational state of the dish washing machine is displayed on the display part 8.

The operation of the dish washing machine with respect to the flow sequence of the wash water will now be described. The spray arms 23, 24 and 25 spray the wash water onto the dishes positioned in the racks. The wash water eventually drips downward through filter 31 and into the sump 30. The pump mounted in sump 30 then recirculates the wash water by pumping it back to the spray arms 23, 24 and 25.

During the circulation of the wash water, food particles and other waste are filtered out by filter 31, as previously mentioned. This allows clean wash water to be recirculated, and it also minimizes the risk of blocking or clogging the spray arms or nozzles associated with the spray arms.

As stated, the dish washing machine may use steam during the dish washing operation. The steam is generated by steam generator 50, as stated. The steam is supplied to the dish washing compartment through the steam flow channel 60 and the steam nozzle 70. Using steam makes for a more efficient and effective dish washing operation. This is due to the high-temperature, high-humidity characteristics of steam. For example, when dishes are exposed to steam, food particles and other waste on the dishes are more thoroughly soaked by the high-temperature, high-humidity steam. Accordingly, steam helps to loosen the food particles and waste adhering to the dishes. Then, when high-pressure wash water is sprayed on the dishes, the food particles and other waste are more easily removed from the dishes.

However, in order to maximize the effect of steam, the steam must be effectively directed at the dishes. To achieve this, the dishes must be effectively positioned and oriented in the dish washing machine rack relative to the steam nozzle 70 and the direction of the steam flow. Accordingly, the steam nozzle 70 is preferably mounted so that the steam can be directly sprayed on to the dishes. Thus, for example, the steam nozzle 70 may be mounted on the wall of tub 20 immediately adjacent to the rack or racks where the dishes are placed.

In the exemplary embodiment illustrated in FIG. 2, the steam nozzle 70 is located adjacent to the lower rack 120. Consequently, dishes placed on rack 120 are in close proximity to the steam nozzle 70. This way, the steam nozzle 70 directly sprays steam on to the dishes.

Figure 3:
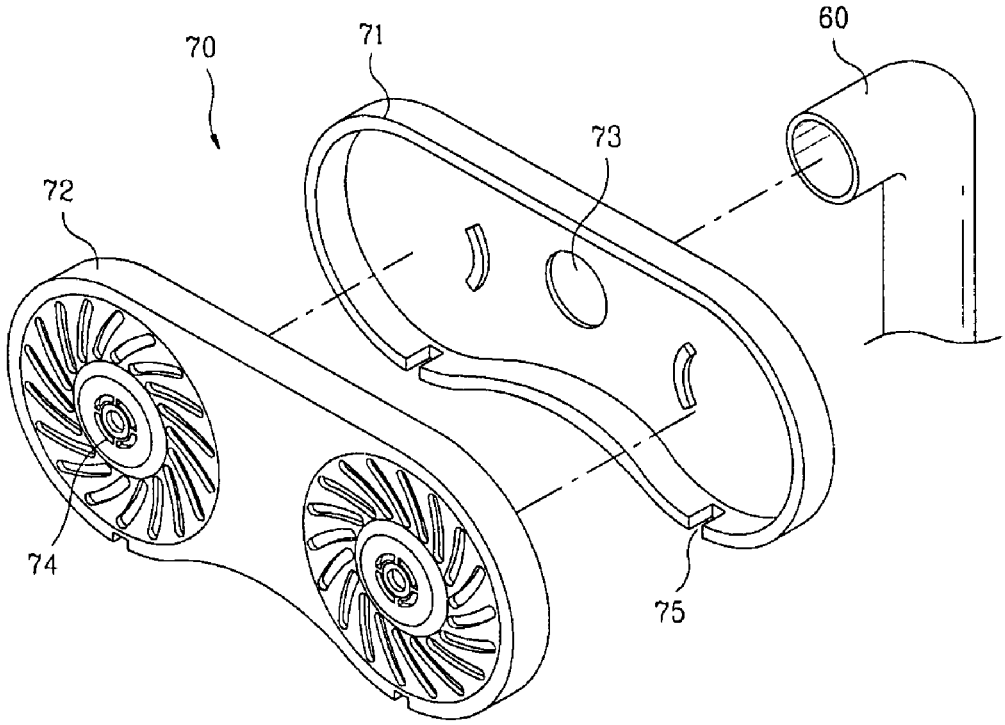
FIG. 3 is an exploded, perspective view of a steam nozzle for use in a dish washing machine according to exemplary embodiments of the present invention.
Figure 4:
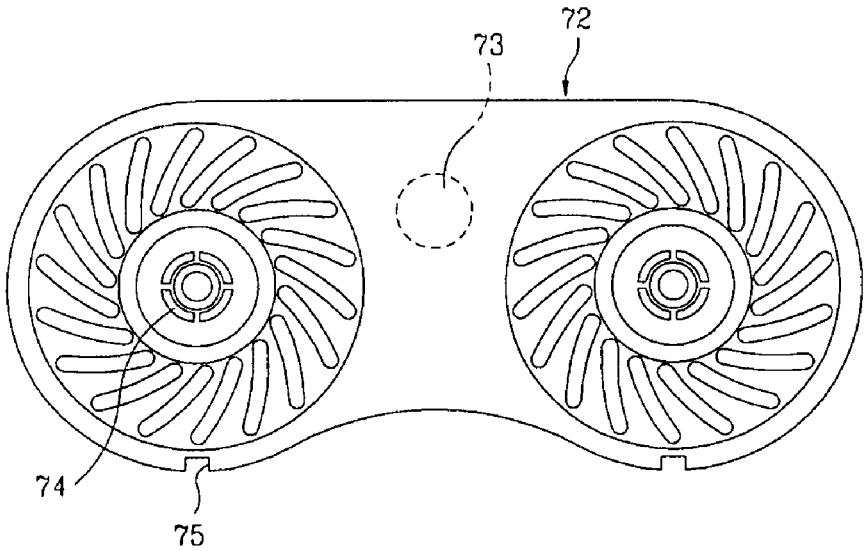
FIG. 4 is a front view of the steam nozzle shown in FIG. 3.

FIG. 3 is an exploded perspective view of the steam nozzle 70, in accordance with exemplary embodiments of the present invention. FIG. 4 is a front view of the steam nozzle 70. As shown, the steam nozzle 70 includes a first case 71 having a coupling port 73. The coupling port 73 receives the steam supply conduit 60. The steam nozzle 70 also includes a second case 72 having two spray ports 74 for spraying the steam supplied through coupling port 73.

In the bottom of the steam nozzle 70, there are two discharge ports 75. If foreign matter such as food waste, gets inside the steam nozzle 70, the discharge ports 75 provide an opening through which the waste can pass to avoid clogging the steam nozzle 70.

The dish washing machine illustrated in FIG. 2 has one steam nozzle 70. However, it will be understood that the dish washing machine may include additional steam nozzles. For example, the dish washing machine may include a steam nozzle mounted adjacent to the upper rack 21 in order to spray steam directly onto dishes placed therein. In fact, the dish washing machine may include any number of steam nozzles that spray steam directly onto dishes placed in any of the dish washing machine racks. Like steam nozzle 70, any one or more of these additional steam nozzles may be mounted to the wall of the tub 18 such that the steam can be effectively directed towards dishes placed in any of the racks. It should be noted, however, that the present invention is not intended to be limited to spraying steam in a specific direction, for example, front-to-back; back-to-front; or side-to-side.

Although the present invention contemplates one or more steam nozzles, the use of longer and/or additional steam nozzles, may actually degrade performance. For example, extending the length of the steam flow conduit 60 may increase the chance that some of the steam in the steam flow conduit 60 will condense to water, thereby reducing the amount of steam that is supplied to the dish washing compartment.

Whether one or more steam nozzles are used, it is important to consider the position and the orientation of the dishes in the one or more dish washing racks, relative to the position of the one or more steam nozzles and the direction of the steam flow, in order to maximize the effects of steam, as previously stated. Although the position and orientation of the dishes are important when multiple steam nozzles are employed, position and orientation are still a concern even if one steam nozzle is employed.

Figure 5:
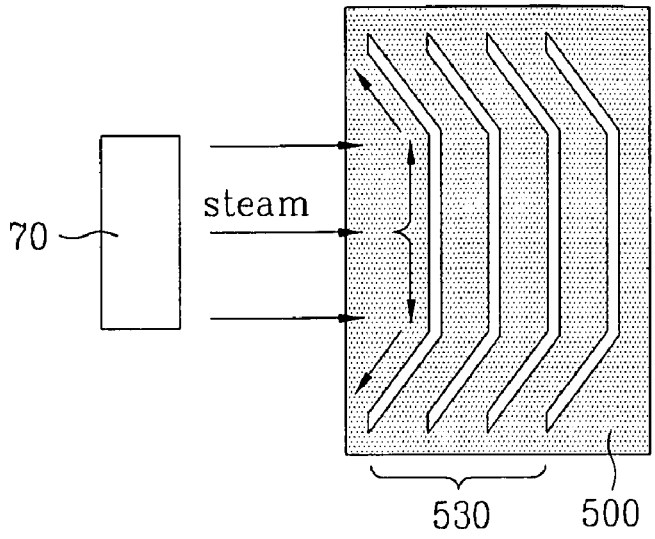
FIG. 5 is a schematic view of an dish washing machine rack according to an exemplary embodiment of the present invent.
Figure 6:
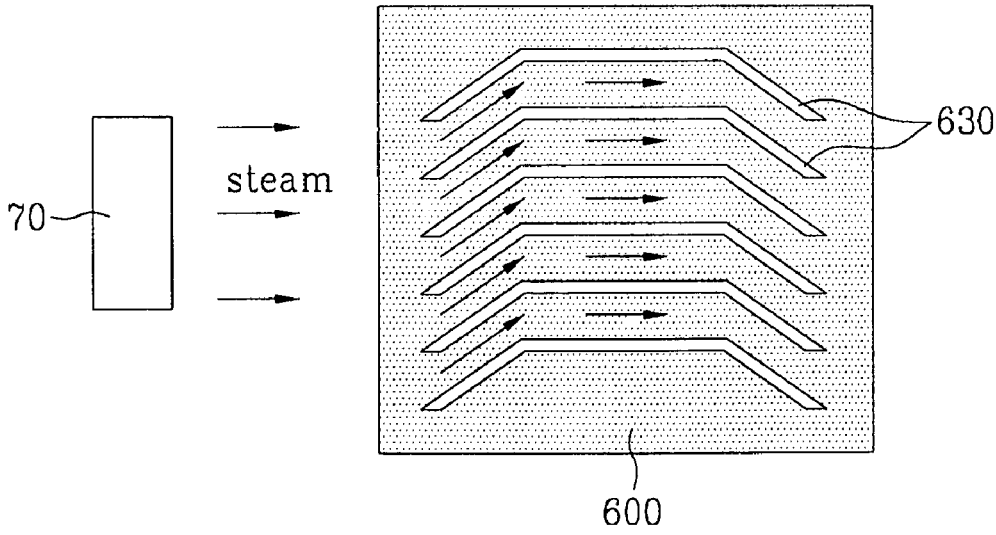
FIG. 6 is a schematic view of an alternative dish washing machine rack.
Figure 7:
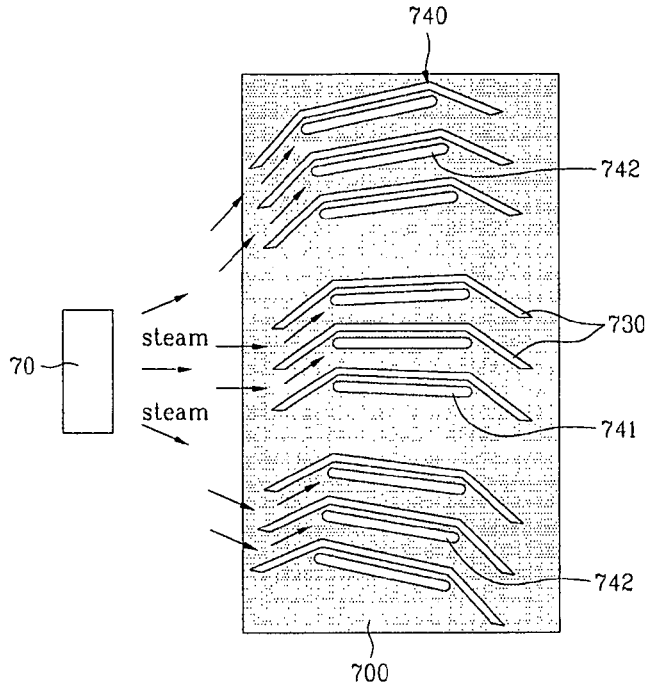
FIG. 7 is a schematic view of a dish washing machine rack according to another exemplary embodiment of the present invention.

First, with respect to orientation, it is preferable that the racks, for example racks 21 and 120, receive the dishes so that no dish impedes the flow of steam, thereby preventing the steam from being evenly directed to the other dishes. FIGS. 5, 6 and 7 address the issue of effectively orienting the dishes.

FIG. 5 illustrates steam nozzle 70 and an exemplary dish washing machine rack 500. The rack 500 is, as shown, configured to receive dishes 530 so that the dishes 530 are positioned adjacent to the steam nozzle 70. The rack 500 is further configured to receive dishes 530 such that they are orientated perpendicular to the direction of the steam spray. When the dishes 530 are arranged in rack 500, perpendicular to the direction of the steam spray, as shown, the steam flow may be inhibited by dish 531, which is immediately adjacent to the steam nozzle 70. As a result, the steam may be redirected, for example, by dish 531 as illustrated by the arrows in FIG. 5. Consequently, the steam may not be evenly distributed to all of the dishes. Furthermore, the various advantages associated with steam may not be completely achieved, and the efficiency of the dish washing machine is decreased. Consequently, it is more preferable that the dish washing rack be constructed in such a way that the dishes are oriented more effectively relative to the direction of the steam spray, as described below.

FIG. 6 illustrates steam nozzle 70 and a rack 600 according to an exemplary embodiment of the present invention. As shown, rack 600 is constructed such that the dishes 630 are oriented in rack 600 parallel to or substantially parallel to the direction of the steam flow. This arrangement allows the steam sprayed from steam nozzle 70 to be more evenly directed onto all of the dishes 630, without substantial redirection of the steam as illustrated in the arrangement of FIG. 5. In contrast to the arrangement illustrated in FIG. 5, no one dish impedes the steam from reaching the other dishes. Therefore, a dish washing machine employing steam and a rack 600, as illustrated in the exemplary embodiment of FIG. 6, maximizes the effectiveness of the steam and the efficiency of the dish washing machine in general.

When the steam nozzle 70 is mounted on the side of the tub 20, such that the steam is generally directed in a side to-side direction, the rack 600 may be constructed so that each of the dishes 630 are orientated side-to-side, parallel to or substantially parallel to the direction of the steam spray. If, however, the steam nozzle 70 is mounted on the rear of the tub 20, or on the door 2, such that the steam nozzle 70 sprays steam in a back-to-front or front-to-back direction, the rack 600 may be constructed so that each of the dishes 630 are likewise oriented front-to-back, parallel with each other and parallel to or substantially parallel to the direction of the steam spray.

It should be noted that mounting one or more steam nozzles on the top of the tub 20 facing downward, or mounted to the bottom of the tub 20 facing upward, is within the scope of the present invention. In either case, the rack or racks, according to exemplary embodiments of the present invention, will be constructed such that the dishes are positioned in close proximity to the steam nozzle or nozzles and oriented parallel to the direction of the steam spray.

FIG. 7 illustrates a rack 700 according to another exemplary embodiment of the present invention. The rack 700, according to this exemplary embodiment, is constructed such that dishes 730 are arranged radially or in a substantially radial orientation with respect to the steam nozzle 70. Because the steam exiting the steam nozzle 70 may spread out in a radial or fan-like pattern, the dishes 730 in this exemplary embodiment are likewise oriented in rack 700 in a radial, or fan-like arrangement relative to the steam nozzle 70. Again, this helps to ensure that the steam is, once again, evenly directed toward all of the dishes 730 and, therefore, that the dish washing machine will effectively employ steam to wash the dishes.

Further, in accordance with the exemplary embodiment illustrated in FIG. 7, the rack 700 includes receiving parts 740. The receiving parts 740, in turn, include a plurality of first support frames 741, positioned in front of the steam nozzle 70, for receiving the dishes 730 so that they are oriented parallel to or substantially parallel to the direction of the steam spray. The receiving parts 740 also include a plurality of second support frames 742, positioned on either side of the first support frames 741. The second support frames 742 are constructed to receive dishes 730 such that the dishes are oriented at predetermined angles relative to the steam nozzle 70. As such, the dishes 730 placed in the second support frames 742 are arranged radially, or in a fan-like orientation, with respect to the steam nozzle 70. Consequently, if and when steam sprayed from the steam nozzle 70, as previously stated, fans-out, it is evenly and effectively supplied to each of the dishes 730.

Figure 8:
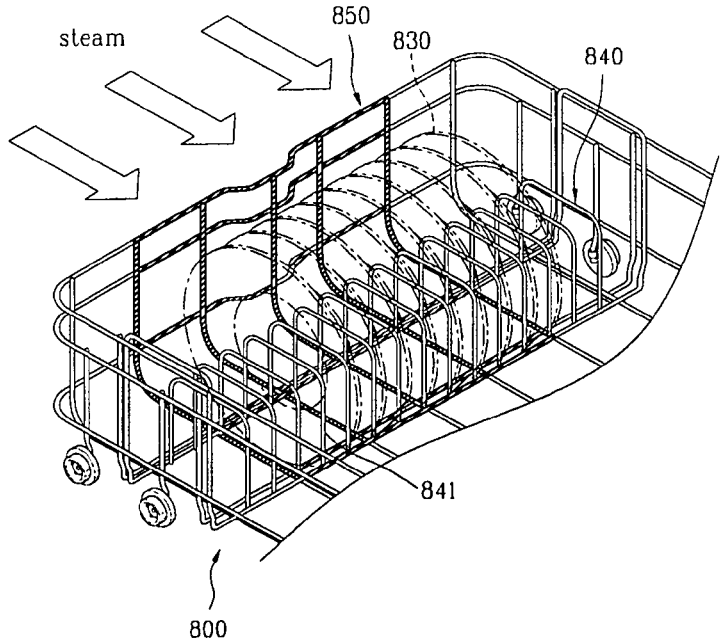
FIG. 8 is a more detailed view of a dish washing machine rack in accordance with an exemplary embodiment of the present invention.
Figure 9:
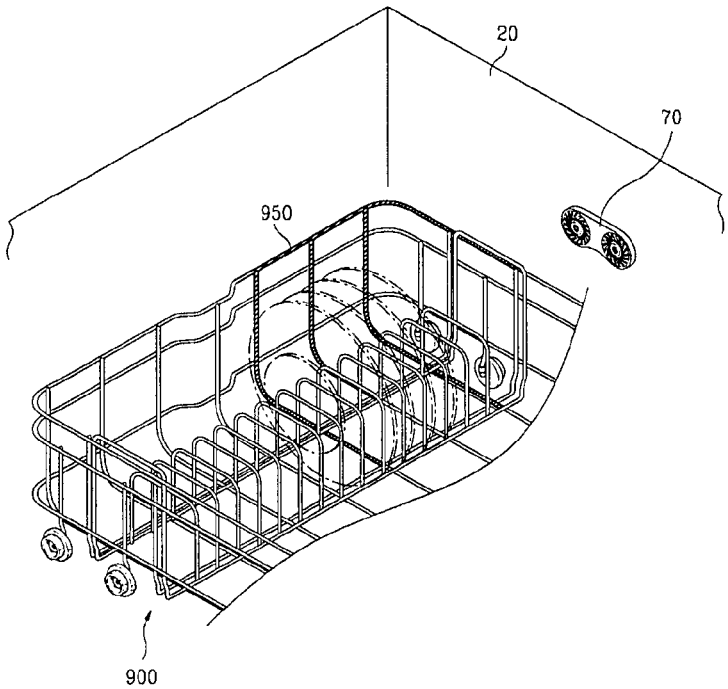
FIG. 9 is a more detailed view of a dish washing machine rack in accordance with another exemplary embodiment of the present invention.
Figure 10:
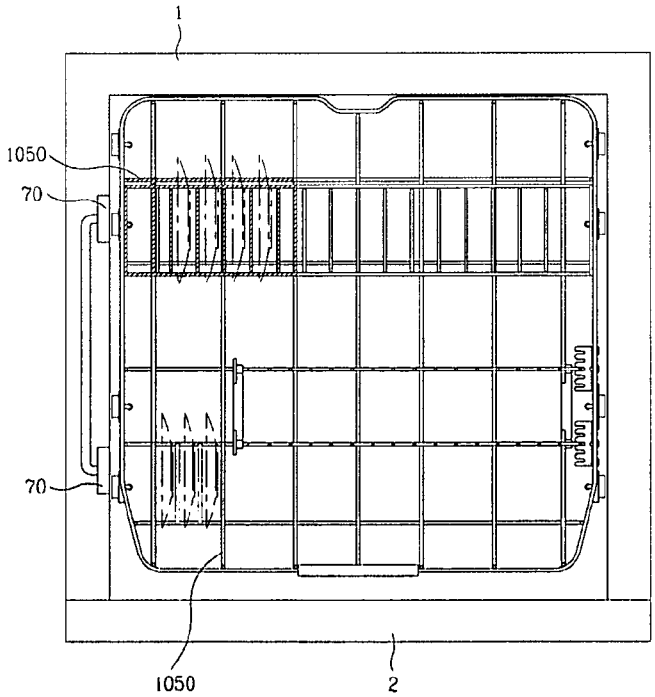
FIG. 10 is a more detailed view of a dish washing machine rack in accordance with still another exemplary embodiment of the present invention.

As stated above, both the position and orientation of the dishes relative to the steam nozzle 70 and the direction of the steam spray are important. The exemplary embodiments described above with reference to FIGS. 6 and 7 dealt mainly with dish orientation. More specifically, FIGS. 6 and 7 illustrated parallel and radial dish orientation relative to the steam nozzle 70 and/or the direction of the steam spray. FIGS. 8, 9 and 10, on the other hand, deal primarily with the position of the dishes relative to the steam nozzle 70. Thus, the dish washing machine according to exemplary embodiments of the present invention further includes a visual steam zone indicator, which identifies the region or zone within the dish washing compartment where the steam is most intense. The indicator aids the user in deciding where to position the dishes, especially those dishes that are particularly dirty and require high-intensity steam. Thus, for example, the user can position the dirtiest dishes within the region or zone defined by the indicator, so those dishes receive the most concentrated amount of steam. This, in turn, improves the effectiveness of the steam and the overall efficiency of the dish washing machine.

FIG. 8 is a more detailed drawing illustrating a dish washing rack 800 in accordance with exemplary embodiments of the present invention. Rack 800 includes receiving parts 840. The receiving parts 840, in turn, include a plurality of support frames 841. In this example, the dishes 830 are positioned between the support frames 841 so that the dishes 830 are oriented parallel to or substantially parallel to the direction of the steam flow, much the same as rack 600 in FIG. 6.

In addition to the orientation of the dishes being parallel to or substantially parallel to the direction of the steam flow, the position of the dishes 830 in rack 800 relative to the steam nozzle 70 is also very important. To assist the user with the positioning of the dishes, rack 800 further includes a steam zone indicator 850. Steam zone indicator 850, as explained, visually identifies for the user the region or zone within the dish washing machine and, more particularly, within the rack 800, that corresponds with the greatest amount (i.e., strongest concentration) of steam by virtue of position relative to the steam nozzle 70.

FIG. 9 is a more detailed view of a rack 900 in accordance with exemplary embodiments of the present invention. Rack 900 is substantially similar to rack 800, however, the location of the steam nozzle 70 is different. Likewise, steam zone indicator 950 is also in a different location compared to indicator 850, due to the fact that the location of the high-intensity steam region or zone, which is a function of the location of the steam nozzle 70, is different as compared to the embodiment illustrated in FIG. 8.

It is also noted that the orientation of the dishes in the exemplary embodiment of FIG. 9, relative to the steam nozzle 70 and the direction of the steam spray, is also different than the embodiment illustrated in FIG. 8. The purpose is to illustrate that the position of the dishes and the orientation of the dishes are two different things. In both FIGS. 8 and 9, the dishes are positioned similarly, that is, in the high-intensity steam zone as defined by indicators 850 and 950, respectively. However, the rack 800, unlike the rack 900, receives the dishes so that they are more effectively orientated parallel to or substantially parallel to the direction of the steam spray. Rack 900, in contrast, receives the dishes so that they are oriented perpendicular to the direction of the steam spray.

FIG. 10 illustrates a rack 1000, in accordance with exemplary embodiments of the present invention. Like racks 800 and 900, illustrated in FIGS. 8 and 9, respectively, rack 1000 includes steam zone indicators 1050 which aid the user in positioning the dishes relative to the steam nozzle, and within the high-intensity steam zone as defined by indicators 1050. Like rack 900, rack 1000 is further constructed to receive dishes oriented perpendicular to the direction of the steam spray, again illustrating that the position of the dishes and the orientation of the dishes are different.

As shown in FIG. 10, the dish washing machine in this exemplary embodiment employs two steam nozzles 70. Consequently, the steam supply conduit 60 is divided into two steam supply conduit branches so that each of the steam nozzles 70 receives steam from steam generator 50. Because the steam washing machine in this exemplary embodiment employs two steam nozzles 70, rack 900 includes two steam zone indicators 1050. Each of the two steam zone indicators 1050 identifies a corresponding one of two high-intensity steam zones, where each of the two high-intensity steam zones corresponds to one of the two steam nozzles 70.

Again, it will be understood that the one or more steam nozzles may be positioned such that the steam sprays in a side-to-side, front-to-back, back-to-front, top-to-bottom or bottom-to-top direction. To achieve this, the one or more steam nozzles may be mounted to the upper, lower, back or side walls of the tub 20, the inner wall of door 2 or the one or more steam nozzles may be otherwise supported within the dish washing compartment. However, regardless of the mounting position or configuration of the one or more steam nozzles, the dish washing rack or racks, in accordance with the various exemplary embodiments described herein, are constructed such that the dishes are effectively positioned and/or oriented with respect to the one or more steam nozzles, the intensity of the steam and the direction of the steam spray.

Additionally, in the aforementioned exemplary embodiments illustrated in FIGS. 8, 9 and 10, the steam zone indicators visibly distinguish a portion of the rack that corresponds with a high-intensity steam zone. This may be achieved any number of ways. For example, the steam zone indicator may take the form of a color scheme that is different than the color of the remaining portion of the rack. However, one skilled in the art will readily appreciate that the steam zone indicator may also be achieved by altering the texture of the corresponding portion of the rack, or the structural appearance of the corresponding portion of the rack, or by visibly altering any visible characteristic of the corresponding portion of the rack.

In addition to or in lieu of the steam zone indicator being associated with the rack, the steam zone indicator may be associated with the tub wall 20 or the inner surface of the door 2. Still further, the steam zone indicator may take the form of a partition that, to some extent, partitions off the high-intensity steam zone. In fact, the steam zone indicator may take on even other forms, so long as it visibly identifies for the user, that portion of the dish washing space or that portion of the rack that generally lines up with the center of the steam nozzle or nozzles and corresponds with the highest concentration of steam coming from the steam nozzle or nozzles.

It will be apparent to those skilled in the art that various modifications and variations can be made to the present invention without departing from the spirit or scope of the invention. Thus, it is intended that the present invention covers these modifications and variations if they come within the scope of the appended claims and their equivalents.

What is claimed is:

1. A dish washing machine comprising:

a tub defining a washing space therein;

a steam generator generating steam during a washing operation;

a steam nozzle spraying steam, generated by the steam generator, into the washing space; and a steam zone indicator visually distinguishing a region within the washing space associated with high-intensity steam.

2. The dish washing machine according to claim 1 further comprising a rack configured to receive items to be washed, wherein the steam zone indicator is associated with the rack.

3. The dish washing machine according to claim 1 further comprising a door, wherein the steam zone indicator is associated with an inner surface of the door.

4. The dish washing machine according to claim 1, wherein the steam zone indicator is associated with a surface of the tub.

5. The dish washing machine according to claim 1, wherein the steam zone indicator comprises a color scheme to visually distinguish the high-intensity steam zone.

6. The dish washing machine according to claim 1, wherein the steam zone indicator comprises a texture scheme to visually distinguish the high-intensity steam zone.

7. The dish washing machine according to claim 1, wherein the steam zone indicator comprises text to visually distinguish the high-intensity steam zone.

8. The dish washing machine according to claim 1, wherein the steam zone indicator comprises a partition to distinguish the high-intensity steam zone.

* * * * *